US005570634A

United States Patent [19]

Harter

[11] Patent Number: 5,570,634

[45] Date of Patent: Nov. 5, 1996

[54] CYLINDER FOR A ROTARY PRESS

[75] Inventor: Wilfried Harter, Worms, Germany

[73] Assignee: Koenig & Bauer-Albert Aktiengesellschaft, Wurzburg, Germany

[21] Appl. No.: 577,343

[22] Filed: Dec. 22, 1995

[30] Foreign Application Priority Data

Dec. 29, 1994 [DE] Germany ..... 44 47 124.6

[51] Int. Cl.[6] ..... B41F 13/10

[52] U.S. Cl. ..... 101/375; 101/216; 492/45

[58] Field of Search ..... 101/212, 216, 101/375, 368, 141; 492/21, 27, 31, 36, 40, 45

[56] References Cited

U.S. PATENT DOCUMENTS

| | | | |
|---|---|---|---|
| 2,460,504 | 2/1949 | Huebner . | |
| 3,205,814 | 9/1965 | Huck . | |
| 3,581,659 | 6/1971 | Bryer . | |
| 4,901,641 | 2/1990 | Steiner et al. | 101/216 |
| 4,913,048 | 4/1990 | Tittgemeyer | 101/216 |
| 4,934,266 | 6/1990 | Fantoni | 101/375 |
| 5,309,832 | 5/1994 | Merkel et al. | 101/216 |

FOREIGN PATENT DOCUMENTS

| | | | |
|---|---|---|---|
| 0051793 | 5/1982 | European Pat. Off. | 101/216 |
| 1135716 | 5/1957 | France | 101/375 |
| 1275904 | 12/1960 | France . | |
| 800932 | 12/1950 | Germany . | |
| 826918 | 1/1952 | Germany . | |
| 3042170 | 9/1983 | Germany . | |
| 8605447 | 9/1986 | WIPO | 101/216 |

*Primary Examiner*—Ren Yan

*Attorney, Agent, or Firm*—Jones, Tullar & Cooper, P.C.

[57] ABSTRACT

A cylinder for a rotary press is removably supported between spaced flanges and journals. The cylinder has a body portion that is provided with axially retractable and extendable trunnions. These trunnions can be extended into engagement with the flanges or can be retracted into the cylinder body so that the cylinder body can be removed from between the flanges.

7 Claims, 2 Drawing Sheets

CYLINDER FOR A ROTARY PRESS

FIELD OF THE INVENTION

The present invention is directed generally to a cylinder for a rotary printing press. More specifically, the present invention is directed to a cylinder which is removable from a rotary printing press. Most particularly, the present invention is directed to a cylinder having detachable cylinder journals. These journals and their integral flanges are connected to a body portion of the cylinder by a plurality of bolts and by axially extendable and retractable trunnions. These trunnions have outer tapered ends which are receivable in tapered recesses or cavities in the flanges of the cylinder support journals. If the cylinder is to be removed from between the press side frames, the bolts will be undone and the trunnions retracted into the cylinder body. The cylinder body can then be removed while leaving the cylinder journals in place.

DESCRIPTION OF THE PRIOR ART

In the field of rotary printing, it is well known to support various cylinders on journals between spaced side frames. In the conventional configuration, the cylinder is formed with integral journals. This presents a problem when it is desirable or perhaps necessary to remove the cylinder from between the press side frames. Since these side frames are typically spaced at a set distance from each other and further since they support a plurality of cylinders and rollers, it is not possible to separate the side frames so that a single cylinder can be removed. In most instances, the side frames are provided with sufficiently large apertures that the cylinder can be removed axially. Such large apertures weaken the side frames and present mounting and centering problems when a replacement cylinder is to be set in place.

One prior art contemplated solution for this problem is set forth in the German patent specification No. DE-PS 800 932. This describes a calendar with removable rolls. The rolls are provided with removable journals. The journals have a tapered cavity and the rolls have roll bodies with tapered shaft ends.

A limitation of this prior arrangement is that at least one of the journals is axially movable and must be moved over a relatively long axial distance to allow the tapered shaft ends of the roll body to be disengaged from the tapered cavities in the journals. This limitation means that sufficient space between the side frames must be provided to accomplish this axial shifting of the journal. This also means that the location of the shaft journal on the frame will be disrupted and will have to be re-set when the new roll body is put in place.

It will be seen that a need exists for a removable cylinder that overcomes the limitations of the prior art devices. The cylinder for a rotary press, in accordance with the present invention, provides such a device and is a significant improvement over the prior art.

SUMMARY OF THE INVENTION

It is an object of the present invention to provide a cylinder for a rotary press.

Another object of the present invention is to provide a cylinder which is removable from a rotary printing press.

A further object of the present invention is to provide a cylinder having detachable cylinder journals.

Yet another object of the present invention is to provide a cylinder for a rotary printing press having separable flanged journals.

Still a further object of the present invention is to provide a removable cylinder for a rotary press having journals which must be shifted axially only over a minimum distance.

As will be discussed in detail in the description of the preferred embodiments which are presented subsequently, the cylinder for a rotary press in accordance with the present invention utilizes a cylinder body that has cylinder journals fastened to either end. These cylinder journals are each flange bearing and each has a central recess or cavity. Retractable trunnions are provided in a body portion of the cylinder. These trunnions are shiftable axially along the axis of rotation of the cylinder body. Each trunnion has a tapered outer end that is received in the cooperatively tapered cavity in the journal flange. The trunnions can be retracted back into the cylinder body by suitable mechanical or hydraulic means. Once the trunnions have been retracted and the connecting bolts removed, the now released cylinder body can be removed from between the side frames while leaving the journals in their original positions.

A particular advantage of the cylinder in accordance with the present invention is that the cylinder journals will remain essentially stationary in the press side frames while the cylinder body is removed. This means that the set-up and positioning of the cylinder journals in the side frames will have to be done only once. This reduces set-up costs.

The distance between the press side frames can be kept at a minimum when using the cylinder in accordance with the present invention. There is not required any additional spacing to accommodate axial offset or shifting of the cylinder journals. The closeness of the side frames with respect to the cylinder body also increases the rigidity of the entire cylinder. This increased rigidity results in an improved print quality.

In the cylinder assembly of the present invention, the flanges of the cylinder journals are securely attached to the cylinder body during operation of the press. Thus no additional forces act on the cylinder bearings, in contrast with the prior art devices.

If the flanges of the cylinder journals are utilized as bearer rings, the cylinder body can be removed without disturbing the engagement of the bearer rings. This will allow the placement of various sleeves onto the cylinder body despite the existence of the bearer rings. By using a cylinder that is provided with both sleeves and bearer rings, the rotary press will be caused to operate in a very quiet or calm manner. Such a mode of operation will again result in the obtaining of the maximum in print quality.

In the cylinder of the present invention, the retractable trunnions and the flanges of the journals have cooperatively shaped engageable tapered ends and cavities, respectively. This cooperative shape of the trunnion outer ends and the journal flange inner surfaces allows a very precise and accurate centering of the cylinder body and the journals.

It will be seen that a cylinder for a rotary printing press in accordance with the present invention overcomes the limitations of the prior art. It is a substantial advance in the art.

BRIEF DESCRIPTION OF THE DRAWINGS

While the novel features of the cylinder for a rotary press in accordance with the present invention are set forth with particularity in the appended claims, a full and complete understanding of the invention may be had by referring to the detailed description of the preferred embodiments which is presented subsequently, and as illustrated in the accompanying drawings, in which:

DETAILED DESCRIPTION OF THE PREFERRED EMBODIMENTS

Figure 1:
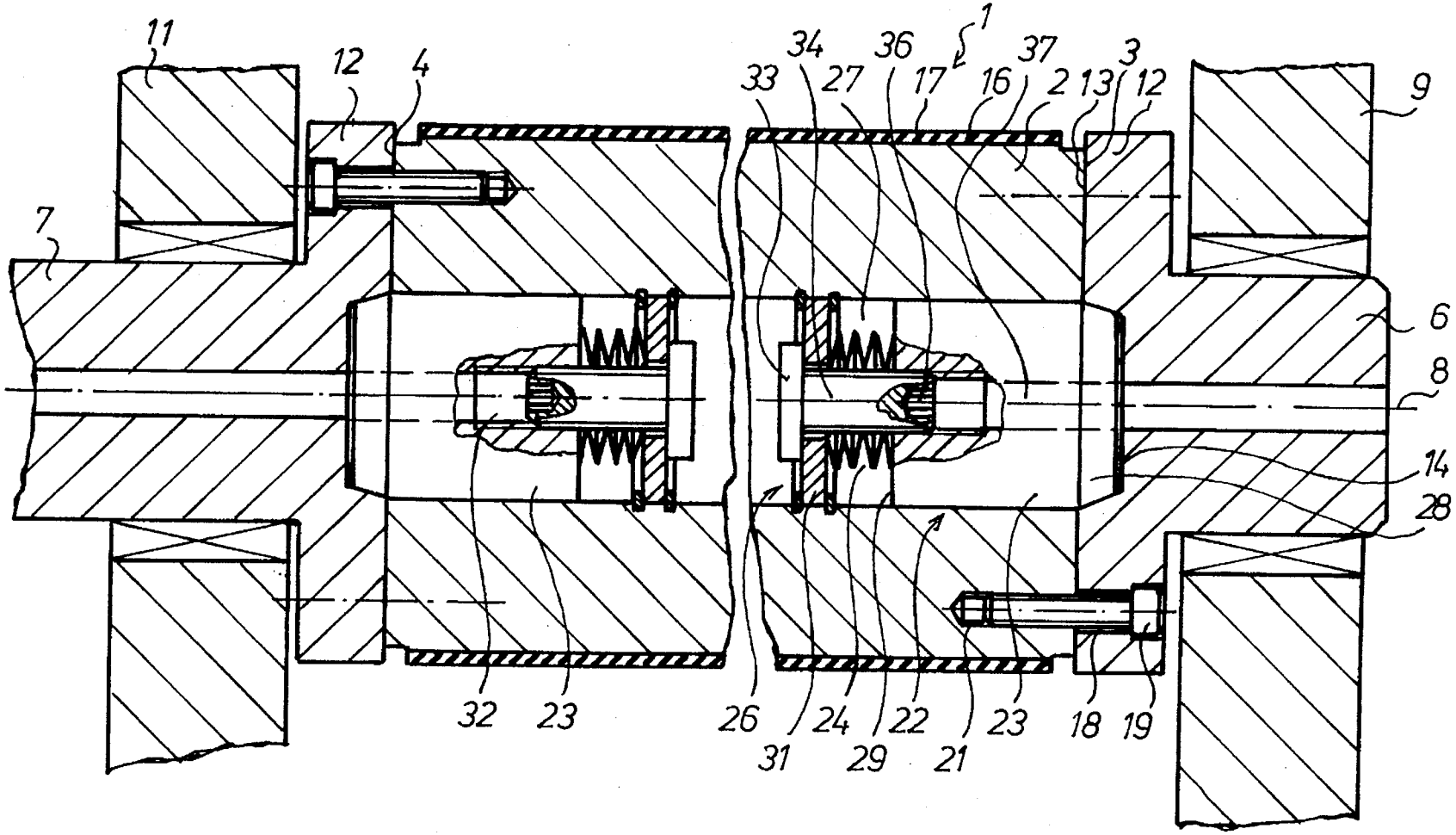
FIG. 1 is a schematic side elevation view, partly in section, of a first preferred embodiment of a cylinder for a rotary press in accordance with the present invention.

Referring initially to FIG. 1, there may be seen, generally at 1, a first preferred embodiment of a cylinder for a rotary press in accordance with the present invention. Cylinder 1 is comprised generally of a cylinder body 2 having end faces 3 and 4 which have cylinder journals 6 and 7 removably attached thereto. These cylinder journals 6 and 7 support the cylinder body 2 for rotation between spaced side frames 9 and 11 of a typical rotary printing press. The structure of the rotary printing press generally forms no part of the subject invention and is not disclosed in detail. The cylinder body 2 and the cylinder journals 6 and 7 rotate about a central axis of rotation 8, as may be seen in FIG. 1. Suitable journal bearings are used to support the journals 6 and 7 in apertures in the side frames 9 and 11.

Each cylinder journal 6 or 7 is formed with an integral flange 12, which may be in the form of a bearer ring. Each of these flanges or bearer rings 12 has an inner face 13 that is adjacent a respective end face 3 or 4 of the cylinder body 2. Each flange inner face 13 is provided with a tapered cavity 14 that is centered on, and concentric with, the axis of rotation 8 of the cylinder 1. As may be seen in FIG. 1, the tapered cavity 14 is generally in the shape of a truncated cone.

The cylinder body 2 can be, for example, a blanket cylinder. In this configuration an outer surface 16 of the cylinder base body 2 can be coated or covered with an endless rubber or other resilient coating 17. The coating 17 can be applied to the outer surface 16 of cylinder body 2 by vulcanizing, bonding, or can be in the form of a sleeve that could be slid into place.

Each flange or bearer ring 12 is provided with several spaced apertures or bores 18 that are situated around the flange 12 and which are parallel with the axis of rotation 8. A bolt 19 extends through each such flange bore 18 and is receivable in a threaded blind bore or tapped hole 21 in the cylinder body 2. These bolts 19 thus are used to secure the flanges 12 of the journals 6 and 7 to the end faces 3 and 4 of the cylinder body 2. It will be understood that one or more appropriately located openings are provided in the side frames 8 and 11 so that the heads of the bolts 19 can be accessed for loosening or tightening of the bolts 19 and hence for the securement or disengagement of the flanges 12 of the journals 6 and 7 with the end faces 3 and 4 of the cylinder body 2.

Again referring to FIG. 1, at least one cylinder centering and loosening device, generally at 22, is provided in the cylinder body 2. This centering and loosening device 22 is in the form of two spaced, axially extendable and retractable trunnions 23. These trunnions 23 are situated in a central, axially extending bore 27 in the cylinder body 2 with bore 27 being concentric with the cylinder axis of rotation 8. A compression spring 24 and an actuating element 26 is carried by each trunnion 23 within the cylinder body 2. Each of the trunnions 23 is axially shiftable within the cylinder bore 27 by operation of the actuating element 26 in a manner as will be discussed shortly.

An outer first end of each trunnion 23 is provided with a tapered end 28. It will be understood that each trunnion tapered outer end 28 is shaped to be cooperatively received in the tapered cavity 14 of the adjacent flange 12 of the respective journal 6 or 7. The compression spring 24 acts against the second, inner end 29 of each trunnion 23. The compression spring 24 for each second inner end 29 of each trunnion 23 has its opposing end in engagement with a stop washer 31 that is carried in the cylinder bore 27. A tapped hole 32 is made in this second, inner end 29 of the trunnion 23. This trunnion tapped hole 32 receives the threaded shank of a tension bolt 34 that carries a collar 33. The collar 33 of the tension bolt 34 is in engagement with the stop washer 31 on a side of the stop washer 31 opposite from its side that is engaged by the free end of the compression spring 24. Rotation of the tension bolt 34 will cause the associated trunnion 23 to move along the axis of rotation 8 either into or out of the body 2 of the cylinder 1. This tension bolt 34 can be rotated by, for example, a drive motor such as a pneumatic motor. Alternatively, the tension bolt 34 can be provided with a hexagonal shaped socket 36 at the end closer to the flange and journal 6 or 7. The journal 6 or 7 is provided, in this first embodiment, with an axial bore which is colinear with an axial bore in the trunnion 23. The trunnion 23 is supported in the cylinder bore 27 fixed against rotation but shiftable axially. For example, the tension bolt 34 can be rotated by insertion of a suitable tool into the hexagonal-shaped socket 36 through the colinear journal and trunnion bores. It is also possible to omit the stop washers 31 and to connect both of the trunnions 23, at their respective inner ends by a common compression spring 24 and a common threaded spindle that has right hand threads on one end and lefthand threads on the other. Actuation of the threaded spindle or the threaded tension bolts 34 will cause the first, outer ends 28 of the trunnion 23 to move toward or away from their cooperating flanges 12. At the outer limits of their travels, the trunnions 23 will have their outer tapered ends 28 fully inserted into the flange tapered cavities 14. At the inner limit of their travels, the trunnions 23 will have their outer ends 28 fully retracted inside the cylinder body 1. Once the trunnions 23 are in this retracted position, the bolts 19 can be removed and the cylinder body 2 can be removed from between the flanges 12 and the journals 6 and 7 while leaving the flanges and journals in place.

Figure 2:
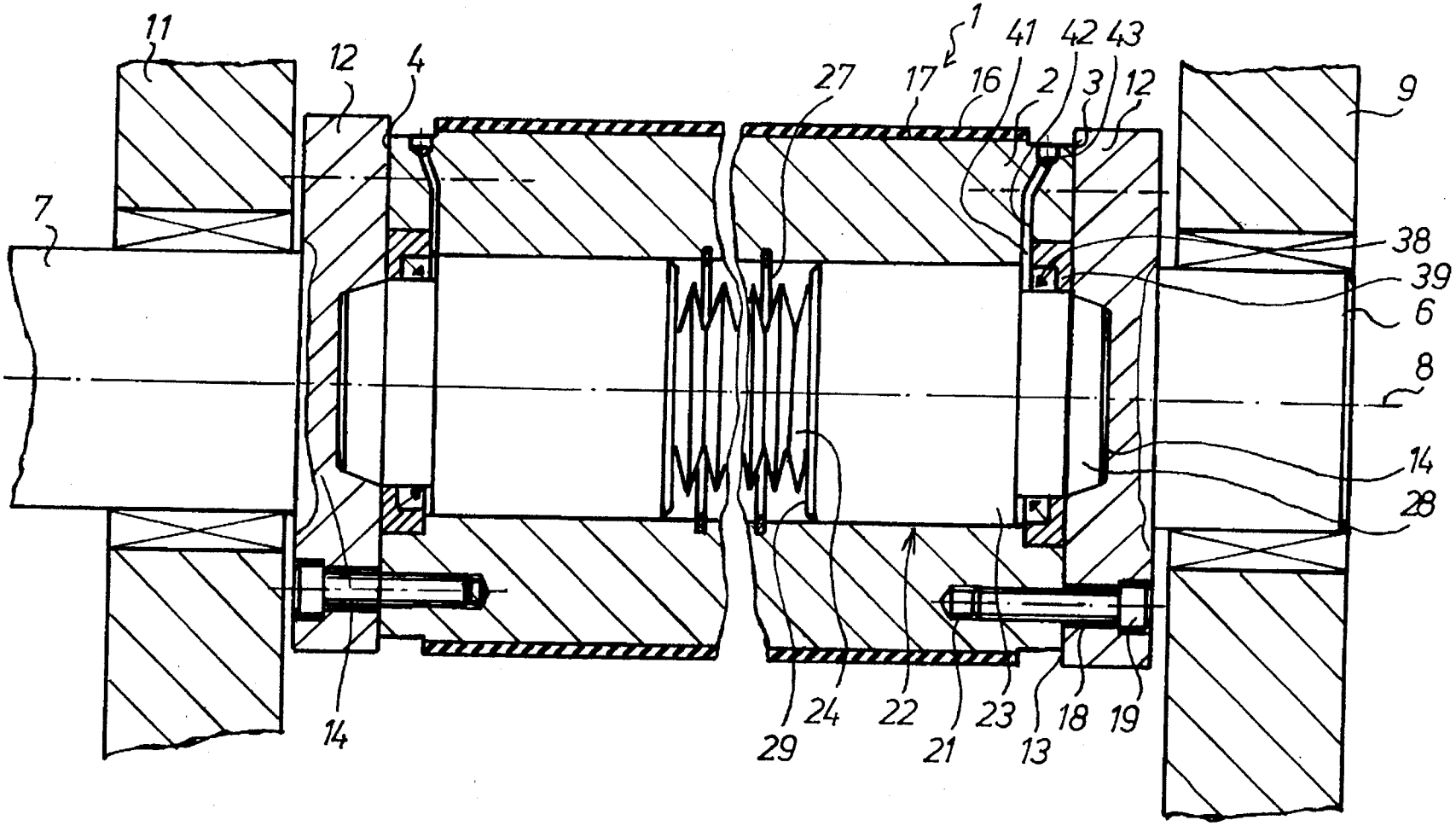
FIG. 2 is a schematic side elevation view, partly in section of a second preferred embodiment of the present invention.

A second preferred embodiment of a cylinder for a rotary press in accordance with the present invention is shown in FIG. 2. In these two preferred embodiments the numerals that identify similar or the same elements are used in both embodiments. In the second preferred embodiment, the axially shiftable trunnions 23 are shiftable by application of a suitable fluid under pressure. Thus in the second preferred embodiment, the trunnions 23 act essentially as hydraulic or pneumatic pistons. In this second preferred embodiment, the tapered end 28 of the trunnion 23 is stepped, as may be seen in FIG. 2. The smaller diameter stepped portion has a diameter which is smaller than the bore 22 of the cylinder body 2. At its face 3 or 4, the cylinder body 2 is closed with a covering washer 39 that is provided with a seal 38. This covering washer 39 is situated in an annular groove in the cylinder end face 3 or 4 which is concentric with the cylinder bore 27. The covering washer 39 is somewhat L-shaped in cross section and cooperates with the stepped portion of the outer end 28 of the trunnion 23 to form a pressure chamber 41. The pressure chamber 41, which is defined by the covering washer 39, the stepped end of the trunnion 23, and the cylinder bore 27, is in fluid communication with a fluid connection opening 43 in the cylinder body 2 by means of a fluid duct 42.

In this second preferred embodiment of the cylinder for a rotary press, it would be possible to interconnect the trunnions 23 at both ends of the cylinder body 2 with the aid of a common working cylinder supplied with a pressure agent. This would leave the pressure chamber 41 out of the cylinder body 2.

In operation, if it is desired to remove a cylinder body 2 from a rotary press in accordance with the first preferred embodiment of the present invention, as seen in FIG. 1, the bolts 19 that connect the journals 6 and the flanges 12 to the cylinder body 2 are loosened. This is accomplished, as discussed previously, by insertion of a suitable tool through the appropriately positioned opening or openings in the side frames 9 and 11. Once these bolts 19 have been removed, the trunnions must be retracted into the axial bore 27 in the cylinder body 2. In the first preferred embodiment, such retraction is accomplished by rotation of the tension bolts 34. The force of the compression springs 24 will initially tend to separate the cylinder body end faces 3 and 4 from the flanges 12 by causing the journals 6 and 7 to slide slightly axially outwardly in the side frames 9 and 11. The tension bolts 34 can be rotated by the use of a suitable tool that is inserted through the central axial bores in the journals 6 and 7 and through the aligned axial bores in the outer ends of the trunnions 23. Rotation of the tension bolts will pull the tapered ends 28 of the trunnions 23 axially away from the tapered cavities 14 in the journal flanges 12. Once the trunnions 23 have been retracted a sufficient distance into the axial bore 27 in the cylinder body 2, at which point the tapered trunnion ends 28 are at least flush with the end faces 3 and 4 of the cylinder body 2, the cylinder body 2 can be removed. As the cylinder body 2 is removed from between the spaced press side frames 9 and 11, the cylinder journals 6 and 7, and their associated flanges 12 will remain in place.

In the second preferred embodiment of the cylinder for a rotary printing press in accordance with the present invention, the flange bolts 19 are removed in the same manner as discussed previously. The tension springs 24 now again tend to force the trunnions 23 axially outwardly to force the flanges 12 and journals 6 and 7 slightly further apart. Once this has been done, a suitable fluid under pressure is connected to the connection openings 43. This pressure fluid passes through the pressure ducts 42 to the appropriate pressure chamber 41. Application of the pressure fluid to these pressure chambers 41 forces the trunnions 23 axially inwardly into the cylinder body 2. In a manner similar to that described in connection with the first preferred embodiment, once the trunnions 23 have been retracted into the cylinder body 2, the cylinder body 2 can be removed from between the spaced press side frames 9 and 11.

While preferred embodiments of a cylinder for a rotary press in accordance with the present invention have been set forth fully and completely hereinabove, it will be apparent to one of skill in the art that a number of changes in, for example, the overall size of the cylinder, the type of bearings used to support the cylinders, the source and type of the pressure fluid and the like may be made without departing from the true spirit and scope of the present invention which is accordingly to be limited only by the following claims.

What is claimed is:

1. A cylinder for a rotary printing press comprising:

a cylinder body having a central axially extending bore;

first and second spaced cylinder journals having cylinder flanges, each cylinder flange having an inner face with a cavity;

first and second cylinder trunnions carried in said cylinder bore, said cylinder trunnions each having an outer end engageable with a corresponding one of said cylinder flange cavities; and means for shifting each of said first and second cylinder trunnions in said cylinder central axially extending bore into and out of engagement with said cylinder flange cavities.

2. The cylinder in accordance with claim 1 wherein each of said cylinder flange inner face cavities is tapered and further wherein said outer end of each of said trunnions is cooperatively tapered.

3. The cylinder in accordance with claim 1 wherein said means for shifting said cylinder trunnions is a tension bolt supported in said cylinder bore and in engagement with said trunnions.

4. The cylinder in accordance with claim 1 further including compression springs in said cylinder bore, said compression springs forcing said trunnions axially in said cylinder bore toward said cylinder flanges.

5. The cylinder in accordance with claim 1 wherein said means for shifting said cylinder trunnion is a pressure agent engageable with an outer end of each of said first and second trunnions.

6. The cylinder of claim 5 further including a stepped outer face on each of said first and second trunnions, forming a concentric shoulder, and a covering washer secured to an end face of said cylinder body, said covering washer and said concentric shoulder forming a pressure chamber for receipt of said pressure agent.

7. The cylinder in accordance with claim 1 wherein said cylinder flanges are bearer rings.

* * * * *